US006567059B1

(12) United States Patent
Ide et al.

(10) Patent No.: US 6,567,059 B1
(45) Date of Patent: May 20, 2003

(54) PLASMA DISPLAY PANEL DRIVING APPARATUS

(75) Inventors: Shigeo Ide, Yamanashi (JP); Masahiro Suzuki, Yamanshi (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 09/441,202

(22) Filed: Nov. 16, 1999

(30) Foreign Application Priority Data

Nov. 20, 1998 (JP) ..... 10-330638
Apr. 1, 1999 (JP) ..... 11-095231

(51) Int. Cl.[7] ..... G09G 3/28

(52) U.S. Cl. ..... 345/60; 315/169.1; 315/169.4; 345/67; 345/68

(58) Field of Search ..... 345/60, 63–66, 345/67–68, 55, 69, 147; 313/582, 584, 586; 315/169.1, 169.3, 169.4

(56) References Cited

U.S. PATENT DOCUMENTS 5,283,556 A 2/1994 Ise ..... 345/174
5,317,334 A 5/1994 Sano ..... 345/148
5,446,344 A * 8/1995 Kanazawa ..... 315/169.4
5,448,024 A 9/1995 Kawaguchi et al. ..... 178/18.07
5,541,479 A 7/1996 Nagakubo ..... 313/586
6,091,380 A * 7/2000 Hashimoto et al. ..... 345/60
6,140,984 A * 10/2000 Kanazawa et al. ..... 345/67
6,144,349 A * 11/2000 Awata et al. ..... 345/67
6,188,374 B1 * 2/2001 Moon ..... 345/60

* cited by examiner

*Primary Examiner*—Richard Hjerpe
*Assistant Examiner*—Francis Nguyen
(74) *Attorney, Agent, or Firm*—Morgan, Lewis & Bockius LLP

(57) ABSTRACT

A plasma display panel driving apparatus for driving a plasma display panel having plural pairs of row electrodes and a plurality of column electrodes laid perpendicular to the pairs of row electrodes, forming discharge cells at respective intersections of the pairs of row electrodes and the column electrodes. The apparatus comprises a scan driver for supplying a scan pulse to one of each of the pairs of row electrodes to select a light-emitting discharge cell and a non-emitting discharge cell, and a discharge sustain driver for supplying a discharge sustain pulse to one of each of the pairs of row electrodes to maintain light emission of only the light-emitting discharge cell.

2 Claims, 9 Drawing Sheets

PLASMA DISPLAY PANEL DRIVING APPARATUS

BACKGROUND OF THE INVENTION

1. Field of the Invention

The present invention relates to a driving apparatus for a plasma display panel (hereinafter called "PDP") of a matrix display type.

2. Description of the Related Background Art

Various studies have been made on PDPs which are thin flat display devices, and one of those PDPs is a matrix display type of PDP.

FIG. 1 is a diagram showing the constitution of a driving apparatus for the matrix display type of PDP.

In FIG. 1, row electrodes $Y_1$ to $Y_n$ and row electrodes $X_1$ to $X_n$, each pair of which corresponds to a single one of rows of one screen (the first row to the n-th row), are formed on a PDP 1. Column electrodes $D_1$ to $D_m$ which correspond to the respective columns of one screen (the first column to the n-th column) are formed perpendicular to those row electrodes each with an unillustrated dielectric layer and discharge space provided in between. Each discharge cell corresponding to a single pixel is formed at the intersection of one pair of row electrodes and a single column electrode.

An address driver 2 converts pixel data of individual pixels based on a video signal to pixel data pulses $DP_1$ to $DP_n$ whose voltage values correspond to the logic levels of the individual pieces of the pixel data, and applies the pixel data pulses to the column electrodes $D_1$–$D_m$ row by row. A row-X electrode driver 3 generates a reset pulse for initializing the amount of the residual wall charges of each discharge cell and a discharge sustain pulse for maintaining the discharge state of each light-emitting discharge cell to be discussed later, and applies those pulses to the row electrodes $X_1$–$X_n$.

A row-Y electrode driver 4, like the row-X electrode driver 3, generates reset pulses each for initializing the amount of the residual wall charges of the associated discharge cell and discharge sustain pulses each for maintaining the discharge state of each light-emitting discharge cell, and applies those pulses to the row electrodes $Y_1$–$Y_n$. The row-Y electrode driver 4 also generates priming pulses for reforming the charge particles that are generated in individual discharge cells and scan pulses each for producing charges whose amount corresponds to the pixel data pulse in the associated discharge cell to thereby set a light-emitting discharge cell or a non-emitting discharge cell, and applies those pulses to the row electrodes $Y_1$–$Y_n$.

FIG. 2 shows the specific constitutions of the row-X electrode driver 3 and the row-Y electrode driver 4 with respect to an electrode $X_j$ and an electrode $Y_j$. The electrode $X_j$ is the j-th one of the electrodes $X_1$–$X_n$ and the electrode $Y_j$ the j-th one of the electrodes $Y_1$–$Y_n$. The part between the electrodes $X_j$ and $Y_j$ serves as a capacitor C0.

The row-X electrode driver 3 is equipped with two power supplies B1 and B2. The power supply B1 provides a voltage $V_{s1}$ (for example, 170 V), and the power supply B2 provides a voltage $V_{r1}$ (for example, 190 V). The positive terminal of the power supply B1 is connected via a switching element S3 to a connection line 11 for the electrode $X_j$, with the negative terminal grounded. A switching element S4 is connected between the connection line 11 and the ground, and a series circuit of a switching element S1, a diode D1 and a coil L1 and a series circuit of a coil L2, a diode D2 and a switching element S2 are both connected via a capacitor C1 to the ground. The end of the diode D1 on that side of the capacitor C1 serves as an anode, and the end of the diode D2 on that side of the capacitor C1 serves as a cathode. The positive terminal of the power supply B2 is connected via a switching element S8 and a resistor R1 to the connection line 11, with the negative terminal grounded.

The row-Y electrode driver 4 is equipped with four power supplies B3 to B6. The power supply B3 provides a voltage $V_{s1}$ (for example, 170 V), the power supply B4 provides a voltage $V_{r1}$ (for example, 190 V), the power supply B5 provides a voltage $V_{off}$ (for example, 140 V) and the power supply B6 provides a voltage $V_h$ (for example, 160 V; $V_h > V_{off}$). The positive terminal of the power supply B3 is connected via a switching element S13 to a connection line 12 for a switching element S15, with the negative terminal grounded. A switching element S14 is connected between the connection line 12 and the ground, and a series circuit of a switching element S11, a diode D3 and a coil L3 and a series circuit of a coil L4, a diode D4 and a switching element S12 are both connected via a capacitor C2 to the ground. The end of the diode D3 on that side of the capacitor C2 serves as an anode, and the end of the diode D4 on that side of the capacitor C2 serves as a cathode.

The connection line 12 is connected via a switching element S15 to a connection line 13 for the positive terminal of the power supply B6. The power supply B4 has a positive terminal grounded and a negative terminal connected via a switching element S16 and a resistor R2 to the connection line 13. The power supply B5 has a positive terminal connected via a switching element S17 to the connection line 13 and a negative terminal grounded.

The connection line 13 is connected via a switching element S21 to a connection line 14 for the electrode $Y_j$. The negative terminal of the power supply B6 is connected via a switching element S22 to the connection line 14. A diode D5 is connected between the connection lines 13 and 14. A series circuit of a switching element S23 and a diode D6 is also connected between the connection lines 13 and 14. The end of the diode D5 on that side of the connection line 14 serves as an anode, and the end of the diode D6 on that side of the connection line 14 serves as a cathode.

The on/off actions of the switching elements S1–S4, S8, S11–S17 and S21–S23 are controlled by a control circuit (not shown). The arrows at the individual switching elements in FIG. 2 indicate terminals for control signals from the control circuit.

In the row-Y electrode driver 4, the power supply B3, the switching elements S11–S15, the coils L3 and L4, the diodes D3 and D4 and the capacitor C2 constitute a sustain driver portion, the power supply B4, the resistor R2 and the switching element S16 constitute a reset driver portion, and the remaining power supplies B5 and B6, switching elements S13, S17, S21 and S22 and diodes D5 and D6 constitute a scan driver portion.

The operation of the PDP driving apparatus with the above constitution will now be explained with reference to a timing chart in FIG. 3. The operation of the PDP driving apparatus consists of a reset period, an address period and a sustain period.

First, in the reset period, the switching element S23 in the row-Y electrode driver 4 is set on. The switching element S23 becomes an on state both in the reset period and sustain period. At the same time, the switching element S8 in the row-X electrode driver 3 is turned on and the switching element S16 in the row-Y electrode driver 4 is turned on.

The other switching elements are off. The on state of the switching element S8 causes a current to flow from the positive terminal of the power supply B2 to the electrode $X_j$ through the switching element S8 and the resistor R1, and the on state of the switching element S16 causes a current to flow from the electrode $Y_j$ to the negative terminal of the power supply B4 through the diode D5, the resistor R2 and the switching element S16. The potential of the electrode $X_j$ gradually increases at the rate specified by the time constant of the capacitor C0 and the resistor R1 and becomes a reset pulse $RP_x$, and the potential of the electrode $Y_j$ gradually decreases at the rate specified by the time constant of the capacitor C0 and the resistor R2 and becomes a reset pulse $RP_y$. The reset pulses $RP_x$ are simultaneously added to the respective electrodes $X_1$–$X_n$, and the reset pulses $RP_y$ are generated for the respective electrodes $Y_1$–$Y_n$ and are simultaneously added to the respective electrodes $Y_1$–$Y_n$.

The simultaneous addition of those reset pulses $RP_x$ and $RP_y$ causes all the discharge cells of the PDP 1 to be excited and discharged, generating charge particles, and a predetermined amount of wall charges are evenly formed in the dielectric layers of the entire discharge cells after the discharging is finished.

After the levels of the reset pulses $RP_x$ and $RP_y$ are saturated, the switching elements S8 and S16 are turned off before the reset period ends. At the point of time, the switching elements S4, S14 and S15 are turned on, causing both the electrodes $X_j$ and $Y_j$ to be grounded. As a result, the reset pulses $RP_x$ and $RP_y$ disappear.

When the address period starts, the switching elements S14 and S15 are turned off, the switching element S23 is turned off and the switching element S17 is turned on at which time the switching element S22 is turned on. The on action of the switching element S17 renders the power supplies B5 and B6 in a series-connected state, so that a negative potential indicating the difference between the voltages $V_h$ and $V_{off}$ appears on the negative terminal of the power supply B6 to be applied to the electrode $Y_j$.

In the address period, the address driver 2 converts pixel data of individual pixels based on a video signal to pixel data pulses $DP_1$ to $DP_n$ whose voltage values correspond to the logic levels of the individual pieces of the pixel data, and sequentially applies the pixel data pulses to the column electrodes $D_1$–$D_m$ row by row. As shown in FIG. 3, pixel data pulses $DP_j$ and $DP_{j+1}$ are respectively applied to the electrodes $Y_j$ and $Y_{j+1}$.

The row-Y electrode driver 4 sequentially applies priming pulses PP of a positive voltage to the row electrodes $Y_1$–$Y_n$. The row-Y electrode driver 4 also sequentially applies scan pulses SP of a negative voltage to the row electrodes $Y_1$–$Y_n$ immediately after the application of the respective priming pulses PP and in synchronism with the respective timings of the pixel data pulses $DP_1$ to $DP_n$.

With regard to the electrode $Y_j$, in generating the priming pulse PP, the switching element S21 is turned on and the switching element S22 is turned off. The switching element S17 stays on. Consequently, the potential $V_{off}$ on the positive terminal of the power supply B5 is applied as the priming pulse PP to the electrode $Y_j$ via the switching element S17 and then the switching element S21. After the application of the priming pulse PP, the switching element S21 is turned off and the switching element S22 is turned on both in synchronism with application of the pixel data pulse $DP_j$ from the address driver 2. As a result, the negative potential on the negative terminal of the power supply B6 which indicates the difference between the voltages $V_h$ and $V_{off}$ is applied as the scan pulse SP to the electrode $Y_j$. In synchronism with the timing at which the application of the pixel data pulse $DP_j$ from the address driver 2 is stopped, the switching element S21 is turned on and the switching element S22 is turned off, causing the potential $V_{off}$ on the positive terminal of the power supply B5 to be applied to the electrode $Y_j$ via the switching element S17 and then the switching element S21. Thereafter, as in the case of the electrode $Y_j$, the priming pulse PP is likewise applied to the electrode $Y_{j+1}$, and the scan pulse SP is applied to the electrode $Y_{j+1}$ in synchronism with application of the pixel data pulse $DP_{j+1}$ from the address driver 2, as shown in FIG. 3.

In the discharge cells related to the row electrode to which the scan pulses SP have been applied, those discharge cells to which the pixel data pulses of a positive voltage have also been applied at the same time discharge and most of the wall charges will be lost. Since no discharging occurs in those discharge cells which have been applied with the scan pulses SP but not the pixel data pulses of a positive voltage, the wall charges remain. At the time, the discharge cells in which the wall charges have remained become light-emitting discharge cells while those from which the wall charges have disappeared become non-emitting discharge cells.

At the transition from the address period to the sustain period, the switching elements S17 and S21 are turned off and the switching elements S14 and S15 are turned on instead. The switching element S4 maintains its on state.

In the sustain period, the on state of the switching element S4 in the row-X electrode driver 3 sets the potential of the electrode $X_j$ nearly to the ground potential of 0 V. When the switching element S4 is turned off and the switching element S1 is turned on, the charges stored in the capacitor C1 cause the current to reach the electrode $X_j$ via the coil L1, the diode D1 and the switching element S1 and flow into the capacitor C0, charging the capacitor C0. At the time, the potential of the electrode $X_j$ gradually increases as shown in FIG. 3 due to the time constant of the coil L1 and the capacitor C0.

Then, the switching element S1 is turned off and the switching element S3 is turned on. Consequently, the potential $V_{s1}$ on the positive terminal of the power supply B1 is applied to the electrode $X_j$. Then, the switching element S3 is turned off and the switching element S2 is turned on, causing the current to flow into the capacitor C1 from the electrode $X_j$ via the coil L2, the diode D2 and the switching element S2 because of the charges stored in the capacitor C0. At the time, the potential of the electrode $X_j$ gradually decreases as shown in FIG. 3 due to the time constant of the coil L2 and the capacitor C1. When the potential of the electrode $X_j$ reaches nearly 0 V, the switching element S2 is turned off and the switching element S4 is turned on.

Through the above operation, the row-X electrode driver 3 applies a discharge sustain pulse $IP_x$ of a positive voltage as shown in FIG. 3 to the electrode $X_j$.

At the same time the switching element S4 is turned on at which the discharge sustain pulse $IP_x$ disappears, the switching element S11 is turned on and the switching element S14 is turned off in the row-Y electrode driver 4. When the switching element S14 is on, the potential of the electrode $Y_j$ is nearly the ground potential of 0 V; however, when the switching element S14 is turned off and the switching element S11 is turned on, the charges stored in the capacitor C2 cause the current to reach the electrode $Y_j$ via the coil L3, the diode D3, the switching element S11, the switching element S15, the switching element S13 and the diode D6 and flow into the capacitor C0, charging the capacitor C0. At the time, the potential of the electrode $Y_j$ gradually increases as shown in FIG. 3 due to the time constant of the coil L3 and the capacitor C0.

Then, the switching element S11 is turned off and the switching element S13 is turned on. Consequently, the potential $V_{s1}$ on the positive terminal of the power supply B3 is applied to the electrode $Y_j$. Then, the switching element S13 is turned off and the switching element S12 is turned on, causing the current to flow into the capacitor C2 from the electrode $Y_j$ via the diode D5, the switching element S15, the coil L4, the diode D4 and the switching element S12 because of the charges stored in the capacitor C0. At the time, the potential of the electrode $Y_j$ gradually decreases as shown in FIG. 3 due to the time constant of the coil L4 and the capacitor C2. When the potential of the electrode $Y_j$ reaches nearly 0 V, the switching element S12 is turned off and the switching element S14 is turned on.

Through the above operation, the row-Y electrode driver 4 applies a discharge sustain pulse $IP_y$ of a positive voltage as shown in FIG. 3 to the electrode $Y_j$.

Since the discharge sustain pulses $IP_x$ and $IP_y$ are alternately generated and are alternately applied to the respective electrodes $X_1$–$X_n$ and the electrodes $Y_1$–$Y_n$ in the sustain period, as apparent from the above, the light-emitting discharge cells where the wall charges remain repeat discharge emission and maintain the light-emitting state.

The conventional PDP driving apparatus is constructed in such a way that the scan driver portion uses a PMOS FET or NMOS FET as the switching element S21 and uses an NMOS FET as the switching element S22, with the node of the series circuit of those switching elements serving as the output to the electrode $Y_j$. In the case, as the on-state resistance of the FET that constitutes the switching element S21 is high, the driving performance becomes considerably poorer than that of the FET that constitutes the switching element S22. Because it is impossible to supply the discharge sustain pulse current from the sustain driver to the electrode $Y_j$ via the switching element S21 during the sustain period, the discharge sustain pulse current is supplied to the electrode $Y_j$ of the PDP through the bypass circuit that has the switching element S13. The scheme undesirably leads to a larger circuit scale and a cost increase.

SUMMARY OF THE INVENTION

Accordingly, it is an object of the present invention to provide a PDP driving apparatus which is capable of supplying a discharge sustain pulse current to a PDP during the sustain period without increasing the circuit scale.

A PDP driving apparatus according to the present invention, which drives a plasma display panel having plural pairs of row electrodes and a plurality of column electrodes laid perpendicular to the pairs of row electrodes, forming discharge cells at respective intersections of the pairs of row electrodes and the column electrodes, comprises a scan driver for supplying a scan pulse to one of each of the pairs of row electrodes to select a light-emitting discharge cell and a non-emitting discharge cell; and a discharge sustain driver for supplying a discharge sustain pulse to one of each of the pairs of row electrodes to maintain light emission of only the light-emitting discharge cell. The scan driver includes two switching elements having one ends commonly connected to one of each of the pairs of row electrodes in such a way that when the scan driver is activated, a first potential is applied to the other end of one of the two switching elements and a second potential lower than the first potential and equal to a potential of the scan pulse is applied to the other end of the other switching element. The output of the discharge sustain driver is electrically connected to the other end of the other switching element when the discharge sustain driver is activated.

According to the present invention, the discharge sustain pulse output from the discharge sustain driver is supplied to one of each pair of row electrodes via the other switching element.

A PDP driving apparatus according to the present invention, which drives a plasma display panel having plural pairs of row electrodes and a plurality of column electrodes laid perpendicular to the pairs of row electrodes, forming discharge cells at respective intersections of the pairs of row electrodes and the column electrodes, comprising a sustain driver for supplying a discharge sustain pulse to one of each of the plural pairs of row electrodes to permit only a light-emitting discharge to maintain light emission; and a scan driver for supplying a scan pulse to one of each of the pairs of row electrodes to select a light-emitting discharge cell and a non-emitting discharge cell. A drive current from the sustain driver flows in the same path in the scan driver at a charging time and a discharging time.

DETAILED DESCRIPTION OF THE PREFERRED EMBODIMENTS

A preferred embodiment of the present invention will now be described with reference to the accompanying drawings.

Figure 1:
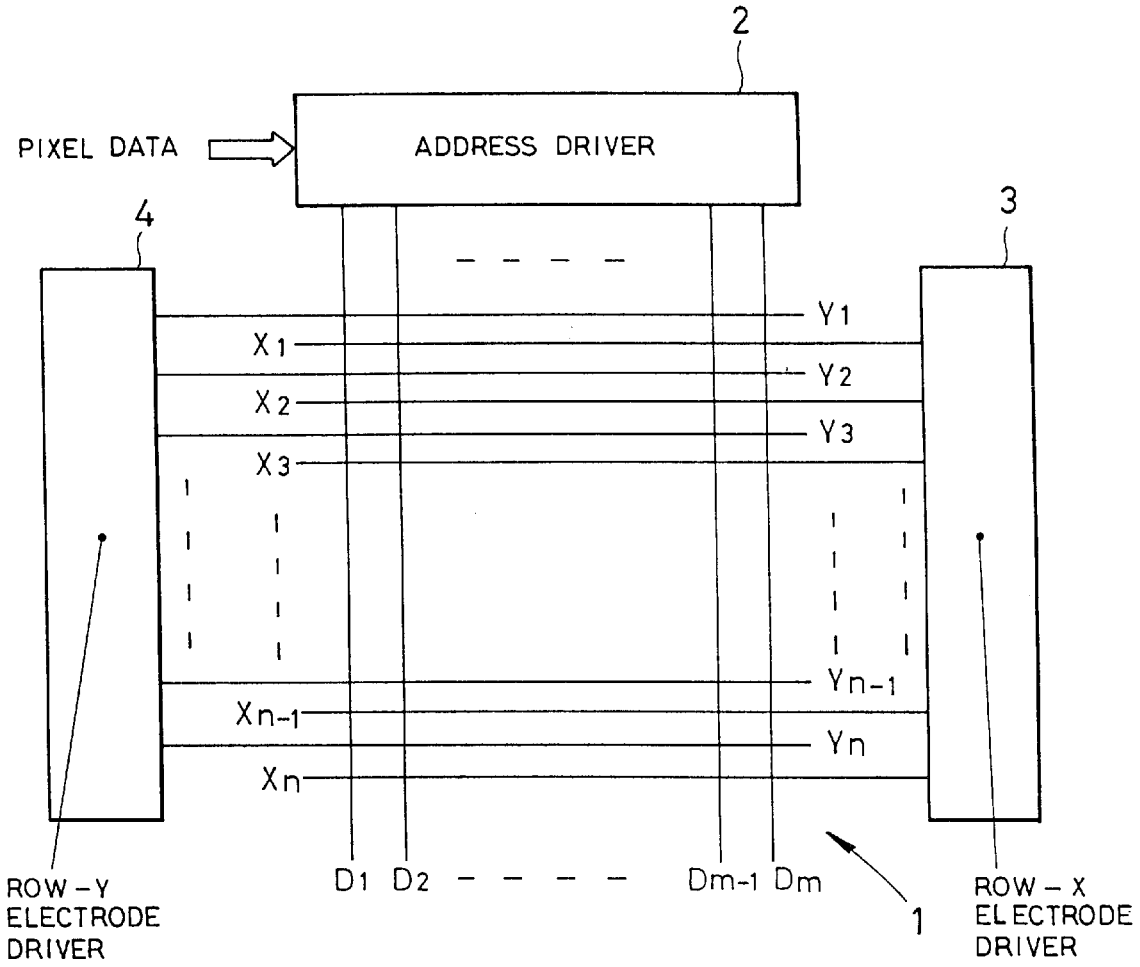
FIG. 1 PRIOR ART
FIG. 1 is a block diagram illustrating a PDP driving apparatus.
Figure 2:
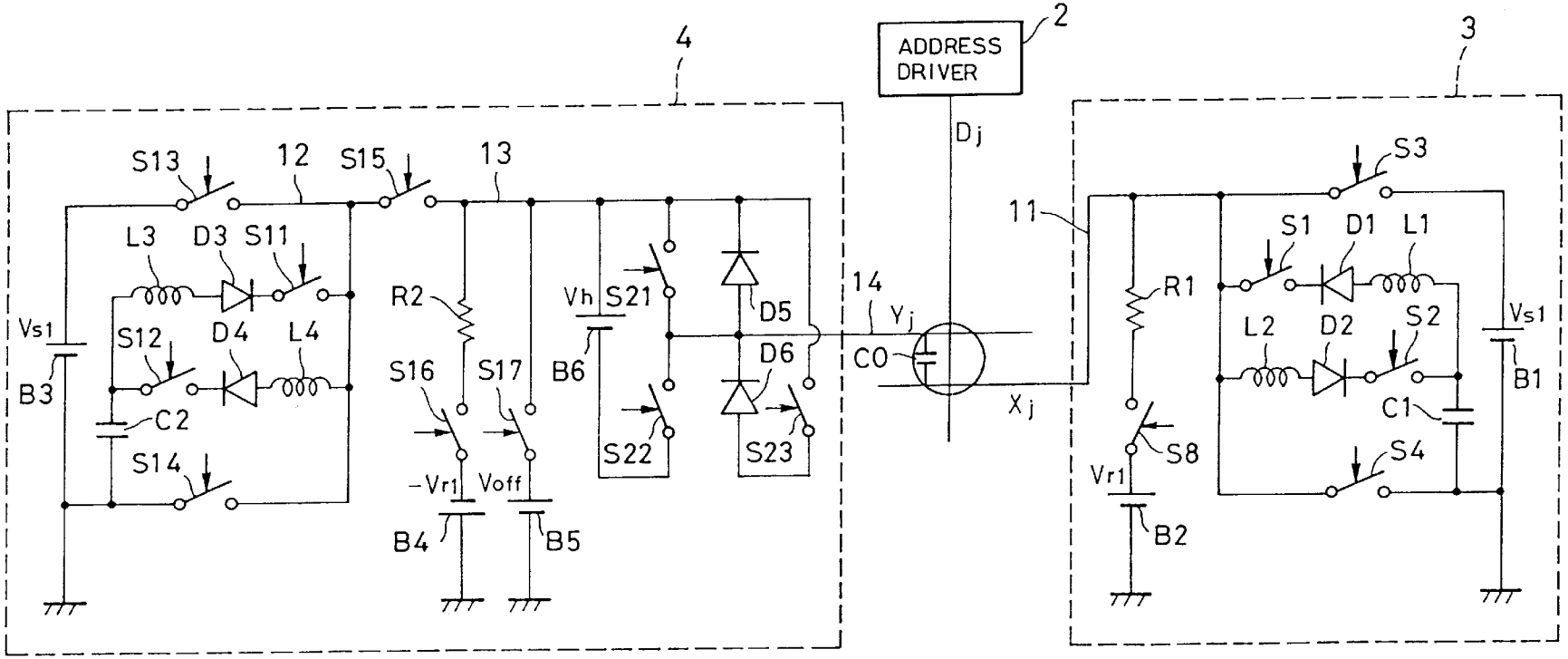
FIG. 2 PRIOR ART
FIG. 2 is a circuit diagram showing the constitution of a conventional driving apparatus.
Figure 4:
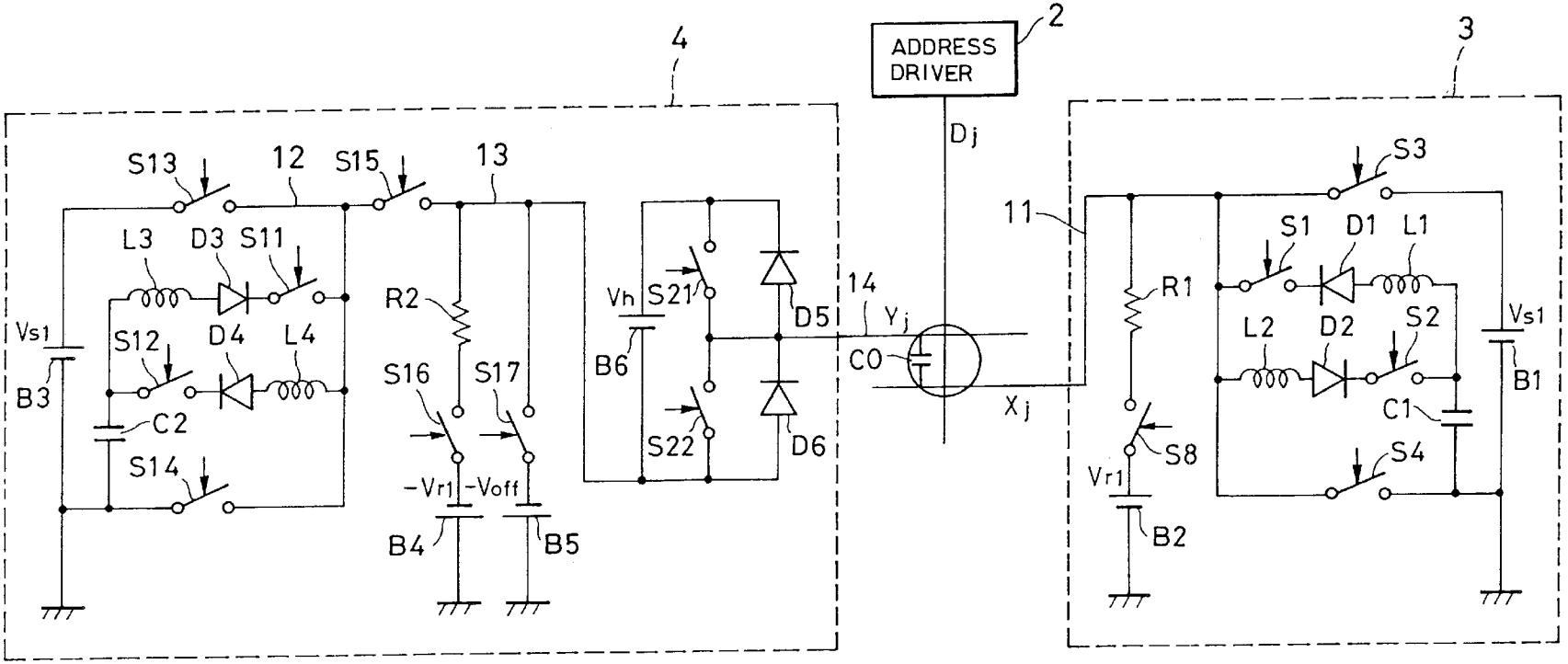
FIG. 4 is a circuit diagram illustrating one embodiment of the present invention.

FIG. 4 illustrates the constitution of a PDP driving apparatus according to the present invention, and uses same reference symbols for those components which are the same as the corresponding components of the conventional apparatus shown in FIGS. 1 and 2. In the PDP driving apparatus shown in FIG. 4, the negative terminal of a power supply B6 is connected to a connection line 13 connected to a switching element S15. The positive terminal of the power supply B6 is connected to a connection line 14 for an electrode $Y_j$ via a switching element S21, and the negative terminal of the power supply B6 that is connected to the connection line 13 is also connected to the connection line 14 via a switching element S22. A diode D5 is connected in parallel to the switching element S21 and a diode D6 is connected in parallel to the switching element S22. The end of the diode D5 on that side of the connection line 14 serves as an anode, and the end of the diode D6 on that side of the connection line 14 serves as a cathode.

A power supply B5 has its positive and negative terminals connected in the opposite manner to that of the conventional apparatus in FIG. 2, and generates a voltage $V_{off}$ of, for example, 10 to 20 V.

Since the other constitution is the same as that of the conventional apparatus shown in FIGS. 1 and 2, its description will not be repeated.

The operation of the PDP driving apparatus of the invention with the above constitution will now be described with reference to a timing chart in FIG. 5. The operation of the PDP driving apparatus, like that of the conventional apparatus in FIG. 2, consists of a reset period, an address period and a sustain period.

First, in the reset period, a switching element S8 in a row-X electrode driver 3 is turned on and switching elements S16 and S22 in a row-Y electrode driver 4 are both turned on. The other switching elements are off. The on state of the switching element S8 causes a current to flow from the positive terminal of a power supply B2 to an electrode $X_j$ through the switching element S8 and a resistor R1, and the on states of the switching elements S16 and S22 cause a current to flow from the electrode $Y_j$ to the negative terminal of a power supply B4 through the switching element S22, a resistor R2 and the switching element S16. The potential of the electrode $X_j$ gradually increases at the rate specified by the time constant of a capacitor C0 and the resistor R1 and becomes a reset pulse $RP_x$, and the potential of the electrode $Y_j$ gradually decreases at the rate specified by the time constant of the capacitor C0 and the resistor R2 and becomes a reset pulse $RP_y$. The reset pulse $RP_x$ finally becomes a voltage $V_{r1}$ and the reset pulse $RP_y$ finally becomes a voltage $-V_{r1}$. The reset pulses $RP_x$ are simultaneously applied to the respective electrodes $X_1$–$X_n$, and the reset pulses $RP_y$ are generated for the respective electrodes $Y_1$–$Y_n$ and are simultaneously applied to the respective electrodes $Y_1$–$Y_n$. The The simultaneous application of those reset pulses $RP_x$ and $RP_y$ causes all the discharge cells of a PDP 1 to be excited and discharged, generating charge particles, and a predetermined amount of wall charges are evenly formed in the dielectric layers of the entire discharge cells after the discharging is finished.

After the levels of the reset pulses $RP_x$ and $RP_y$ are saturated, the switching elements S8, S16 and S22 are turned off before the reset period ends. At the point of time, the switching elements S4, S14 and S15 are turned on, causing both the electrodes $X_j$ and $Y_j$ to be grounded. As a result, the reset pulses $RP_x$ and $RP_y$ disappear.

When the address period starts, the switching elements S14 and S15 are turned off, and a switching element S17 is turned on at which time the switching element S22 is turned on. The on states of the switching elements S17 and S22 causes the negative potential $-V_{off}$ on the negative terminal of the power supply B5 to be applied to the electrode $Y_j$ via the switching element S17 and then the switching element S22.

In the address period, an address driver 2 converts pixel data of individual pixels based on a video signal to pixel data pulses $DP_1$ to $DP_n$ whose voltage values correspond to the logic levels of the individual pieces of the pixel data, and sequentially applies the pixel data pulses to column electrodes $D_1$–$D_m$ row by row. As shown in FIG. 5, pixel data pulses $DP_j$ and $DP_{j+1}$ are respectively applied to the electrodes $Y_j$ and $Y_{j+1}$.

The row-Y electrode driver 4 sequentially applies priming pulses PP of a positive voltage to the row electrodes $Y_1$–$Y_n$. The row-Y electrode driver 4 also sequentially applies scan pulses SP of a negative voltage to the row electrodes $Y_1$–$Y_n$ immediately after the application of the respective priming pulses PP and in synchronism with the respective timings of the pixel data pulses $DP_1$ to $DP_n$.

With regard to the electrode $Y_j$, in generating the priming pulse PP, the switching element S21 is turned on and the switching element S22 is turned off. The switching element S17 stays on. Consequently, the power supplies B6 and B5 are rendered in a series-connected state via the switching element S17, the potential on the positive terminal of the power supply B6 becomes $V_h$–$V_{off}$ (e.g., 140 V). The positive potential is applied as the priming pulse PP to the electrode $Y_j$ via the switching element S21.

After the application of the priming pulse PP, the switching element S21 is turned off and the switching element S22 is turned on both in synchronism with application of the pixel data pulse $DP_j$ from the address driver 2. As a result, the negative potential $-V_{off}$ on the negative terminal of the power supply B5 is applied as the scan pulse SP to the electrode $Y_j$ via the switching element S17 and then the switching element S22. In synchronism with the timing at which the application of the pixel data pulse $DP_j$ from the address driver 2 is stopped, the switching element S21 is turned on and the switching element S22 is turned off, causing the potential $V_h$–$V_{off}$ on the positive terminal of the power supply B6 to be applied to the electrode $Y_j$ via the switching element S21. Thereafter, as in the case of the electrode $Y_j$, the priming pulse PP is likewise applied to the electrode $Y_{j+1}$, and the scan pulse SP is applied to the electrode $Y_{j+1}$ in synchronism with application of the pixel data pulse $DP_{j+1}$ from the address driver 2 as shown in FIG. 5.

In the discharge cells related to the row electrode to which the scan pulses SP have been applied, those discharge cells to which the pixel data pulses of a positive voltage have also been applied at the same time discharge and most of the wall charges will be lost. Since no discharging occurs in those discharge cells which have been applied with the scan pulses SP but not the pixel data pulses of a positive voltage, the wall charges remain. At the time, the discharge cells in which the wall charges have remained become light-emitting discharge cells while those from which the wall charges have disappeared become non-emitting discharge cells.

When the address period is switched to the sustain period, the switching elements S17 and S21 are turned off and the switching elements S14 and S15 are turned on instead. The switching element S4 maintains its on state.

Figure 5:
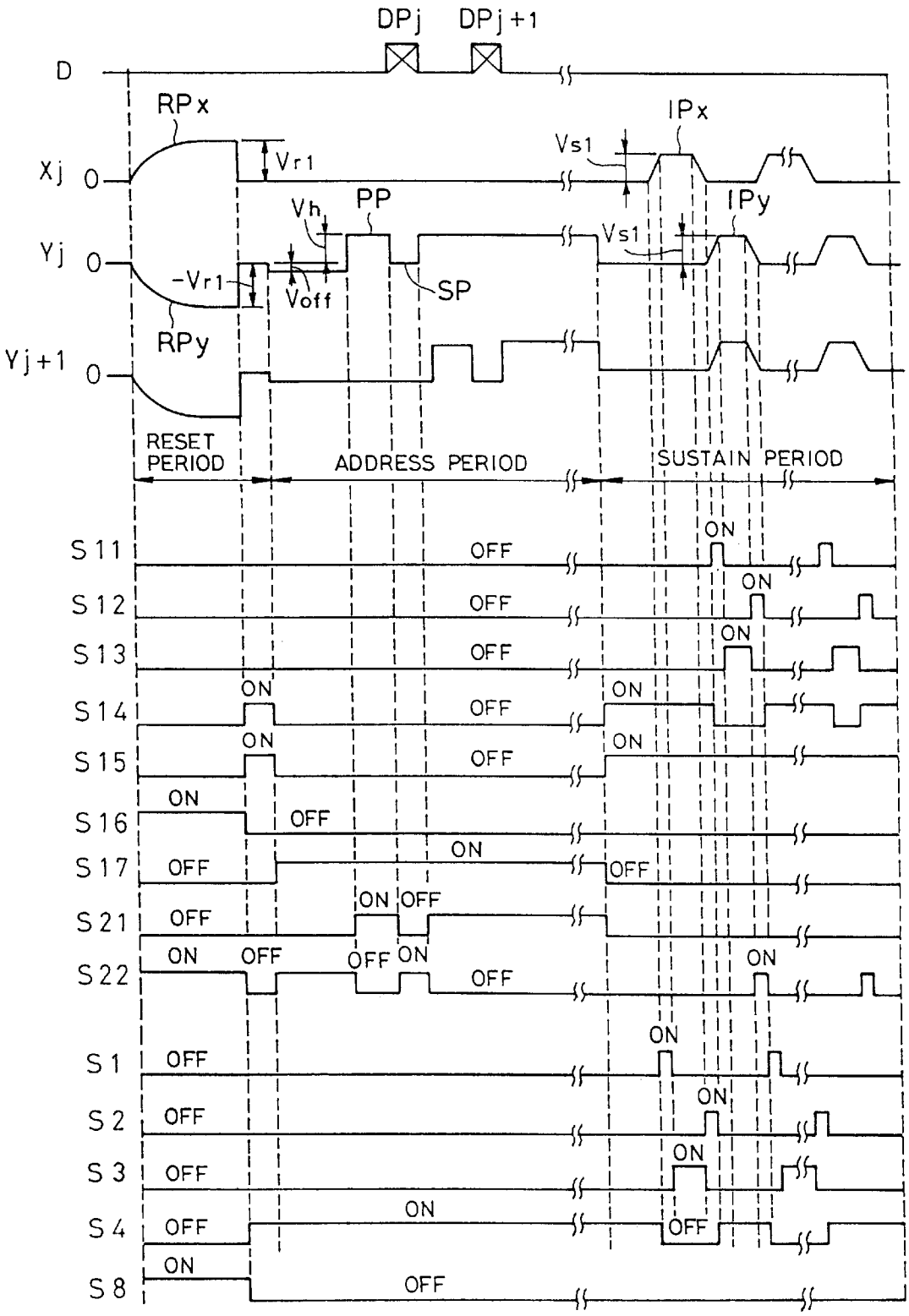
FIG. 5 is a timing chart for the individual sections of the apparatus in FIG. 4.

Because the operation of the row-X electrode driver 3 in the sustain period is the same as that of the conventional apparatus shown in FIG. 2, the description for the operation will be omitted, except that the row-X electrode driver 3 applies the discharge sustain pulse $IP_x$ of a positive voltage as shown in FIG. 5 to the electrode $X_j$.

At the same time the switching element S4 is turned on at which the discharge sustain pulse $IP_x$ disappears, the switching element S11 is turned on and the switching element S14 is turned off in the row-Y electrode driver 4. When the switching element S14 is on, the potential of the electrode $Y_j$ is nearly the ground potential of 0 V; however, when the switching element S14 is turned off and the switching element S11 is turned on, the charges stored in a capacitor C2 cause the current to reach the electrode $Y_j$ via the coil L3, the diode D3, the switching element S11, the switching element S15 and the diode D6 and flow into the capacitor C0, charging the capacitor C0. At the time, the potential of the electrode $Y_j$ gradually increases as shown in FIG. 5 due to the time constant of the coil L3 and the capacitor C0.

Then, the switching element S11 is turned off and the switching element S13 is turned on. Consequently, the potential $V_{s1}$ on the positive terminal of the power supply B3 is applied to the electrode $Y_j$ via the switching element S13, the switching element S15 and the diode D6. Then, the switching element S13 is turned off, the switching element S12 is turned on and the switching element S22 is also turned on, causing the current to flow into the capacitor C2 from the electrode $Y_j$ via the switching element S22, the switching element S15, the coil L4, the diode D4 and the switching element S12 because of the charges stored in the capacitor C0. At the time, the potential of the electrode $Y_j$ gradually decreases as shown in FIG. 5 due to the time constant of the coil L4 and the capacitor C2. When the potential of the electrode $Y_j$ reaches nearly 0 V, the switching elements S12 and S22 are turned off and the switching element S14 is turned on.

Through the above operation, the row-Y electrode driver 4 applies a discharge sustain pulse $IP_y$ of a positive voltage as shown in FIG. 5 to the electrode $Y_j$.

Since the discharge sustain pulses $IP_x$ and $IP_y$ are alternately generated and are alternately applied to the respective electrodes $X_1$–$X_n$ and the electrodes $Y_1$–$Y_n$ in the sustain period, as apparent from the above, the light-emitting discharge cells where the wall charges remain repeat discharge emission and maintain the light-emitting state.

Figure 6:
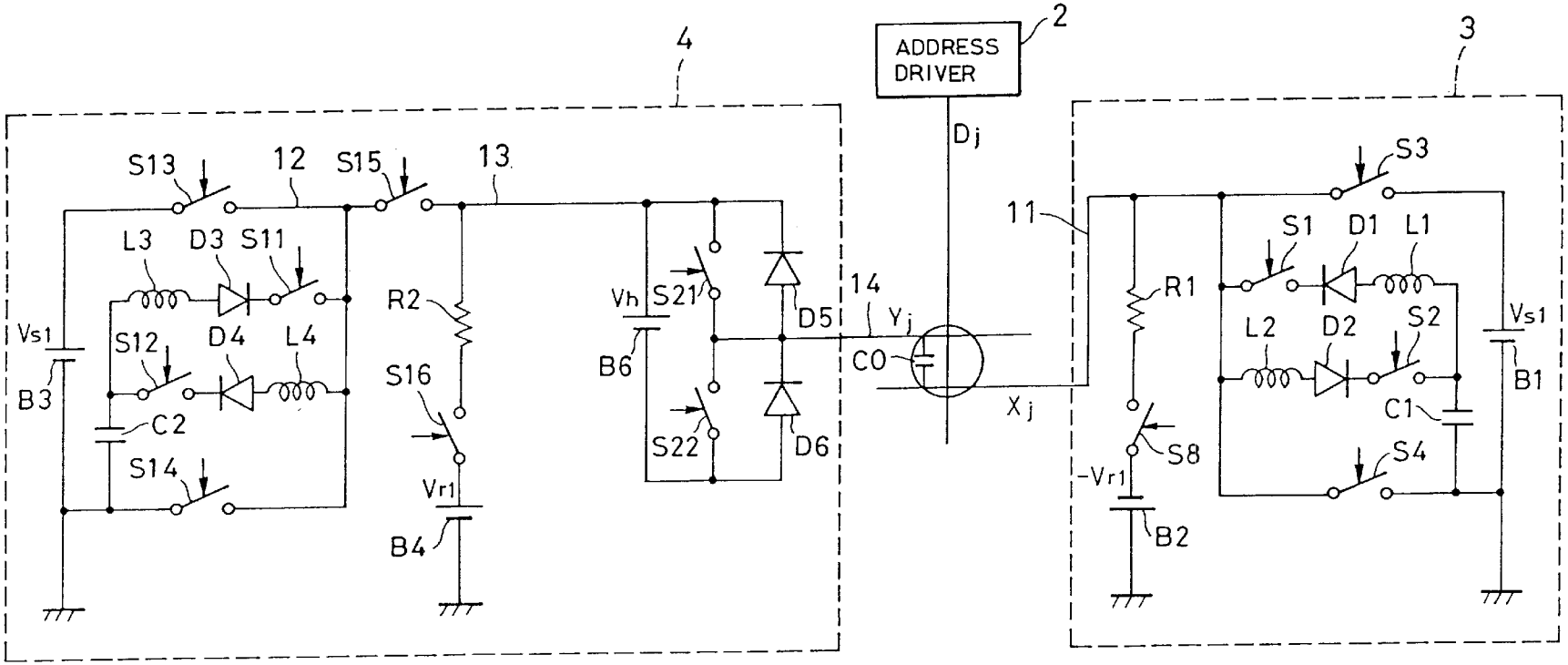
FIG. 6 is a circuit diagram illustrating another embodiment of the present invention.

FIG. 6 illustrates the structure of a PDP driving apparatus according to another embodiment of the present invention, and uses the same reference symbols as used for those components which are the same as the corresponding components of the conventional apparatus shown in FIGS. 1 and 2 and the embodiment in FIG. 4. In the PDP driving apparatus in FIG. 6, the positive terminal of the power supply B6 is directly connected to the connection line 13 and is further connected to the connection line 14 for the electrode $Y_j$ via the switching element S21, and the negative terminal of the power supply B6 is also connected to the connection line 14 via the switching element S22. The diode D5 is connected in parallel to the switching element S21 and the diode D6 is connected in parallel to the switching element S22. The end of the diode D5 on that side of the connection line 14 serves as an anode, and the end of the diode D6 on that side of the connection line 14 serves as a cathode.

In the PDP driving apparatus in FIG. 6, the switching element S17 and the power supply B5 both illustrated in FIG. 2 are not provided.

The power supply B2 has a negative terminal connected to one end of the switching element S8 and a positive terminal grounded. The power supply B4 has a positive terminal connected to one end of the switching element S16 and a negative terminal grounded. The power supply B6 provides a voltage $V_h$ (for example, 10 to 20 V).

Since the other structure is the same as that of the conventional apparatus shown in FIGS. 1 and 2, its description will not be given below.

The operation of the thus constituted driving apparatus for the PDP 1 will now be described with reference to a timing chart in FIG. 7. The drive sequence of this PDP 1 has one cycle consisting of a reset period, an address period and a sustain period.

First, when the sequence enters the reset period, the switching element S21 in the row-Y electrode driver 4 is turned on, and, simultaneously, the switching element S8 in the row-X electrode driver 3 and the switching element S16 in the row-Y electrode driver 4 are turned on. The other switching elements are off during the reset period. The on state of the switching element S8 causes a current to flow to the negative terminal of the power supply B2 from the electrode $X_j$ through the resistor R1 and the switching element S8. The on state of the switching element S16 cause a current to flow to the electrode $Y_j$ from the positive terminal of the power supply B4 through the switching element S16, the resistor R2 and the switching element S21. The potential of the electrode $X_j$ gradually decreases at the rate specified by the time constant of the capacitor C0 and the resistor R1 and becomes the reset pulse $RP_x$, and the potential of the electrode $Y_j$ gradually increases at the rate specified by the time constant of the capacitor C0 and the resistor R1 and becomes the reset pulse $RP_y$. The reset pulses $RP_x$ are simultaneously applied to the respective row electrodes $X_1$ to $X_n$ and the reset pulses $RP_y$ are likewise simultaneously applied to the respective row electrodes $Y_1$ to $Y_n$.

The simultaneous application of those reset pulses $RP_x$ and $RP_y$ causes all the discharge cells of the PDP 1 to be excited for the discharge action, generating charge particles. After the discharging is completed, a predetermined amount of wall charges are evenly formed in the dielectric layers of the entire discharge cells, rendering those cells in a light-emitting discharge state.

After a predetermined time passes and the levels of the reset pulses $RP_x$ and $RP_y$ are saturated, the switching elements S8 and S16 are turned off. At this point of time, the switching elements S4, S14 and S15 are turned on, causing both the electrodes $X_j$ and $Y_j$ to be grounded. As a result, the reset pulses $RP_x$ and $RP_y$ disappear.

Next, the address period starts, in which the address driver 2 selectively forms wall charges with respect to the individual discharge cells based on a video signal, thus generating pixel data pulses $DP_1$ to $DP_m$ for setting light-emitting discharge cells or non-emitting discharge cells, and applies the pixel data pulses to column electrodes $D_1$–$D_m$ row by row. As shown in FIG. 7, pixel data pulses $DP_j$ and $DP_{j+1}$ are respectively applied to the electrodes $Y_j$ and $Y_{j+1}$. The row-Y electrode driver 4 sequentially applies scan pulses SP of a negative voltage to the row electrodes $Y_1$–$Y_n$ in synchronism with the respective timings of the pixel data pulses $DP_1$ to $DP_m$.

With regard to the electrode $Y_j$, in synchronism with the application of the pixel data pulse $DP_j$ from the address driver 2, the switching element S21 is turned off and the switching element S22 is turned on. As a result, a negative potential indicating the voltage $-V_h$ on the negative terminal of the power supply B6 is applied to the electrode $Y_j$ as the scan pulse SP. In synchronism with the end of the pixel data pulse $DP_j$ from the address driver 2, the switching element S21 is turned on and the switching element S22 is turned off, causing the electrode $Y_j$ to be grounded. Thereafter, as in the case of the electrode $Y_j$, the scan pulse SP is likewise applied to the electrode $Y_{j+1}$ in synchronism with application of the pixel data pulse $DP_{j+1}$ from the address driver 2, as shown in FIG. 7.

Of the discharge cells relating to the row electrode to which the scan pulses have been applied, only those discharge cells to which the respective pixel data pulses of a positive voltage have also been applied have a discharge action and the wall charges will be lost. Since no discharging occurs in those discharge cells which have been applied with the scan pulses but not with the respective pixel data pulses of a positive voltage, the wall charges remain. At the time, the discharge cells in which the wall charges have remained become light-emitting discharge cells while those from which the wall charges have disappeared become non-emitting discharge cells.

Then, the sustain period starts in which as the switching element S4 is turned off and the switching element S1 is turned on, the current flows to the electrode $X_j$ via the coil L1, the diode D1 and the switching element S1 based on the charges stored in the capacitor C1, charging the capacitor C0. At the time, the potential of the electrode $X_j$ gradually increases as shown in FIG. 7 due to the time constant of the coil L1 and the capacitor C0. When a half of the resonance period determined by the coil L1 and the capacitor C0 passes, the switching element S1 is turned off and the switching element S3 is turned on. Consequently, the potential of the electrode $X_j$ is clamped to the potential $V_{s1}$ on the positive terminal of the power supply B1.

After a predetermined time elapses, the switching element S3 is turned off and the switching element S2 is turned on, causing the current to flow into the capacitor C1 via the coil L2, the diode D2 and the switching element S2 because of the charges stored in the capacitor C0, thus charging the capacitor C1. At the time, the potential of the electrode $X_j$ gradually decreases as shown in FIG. 7 due to the time constant of the coil L2 and the capacitor C0. When a half of the resonance period determined by the coil L2 and the capacitor C0 passes (when the potential of the electrode $X_j$ reaches 0 V), the switching element S2 is turned off and the switching element S4 is turned on.

Figure 7:
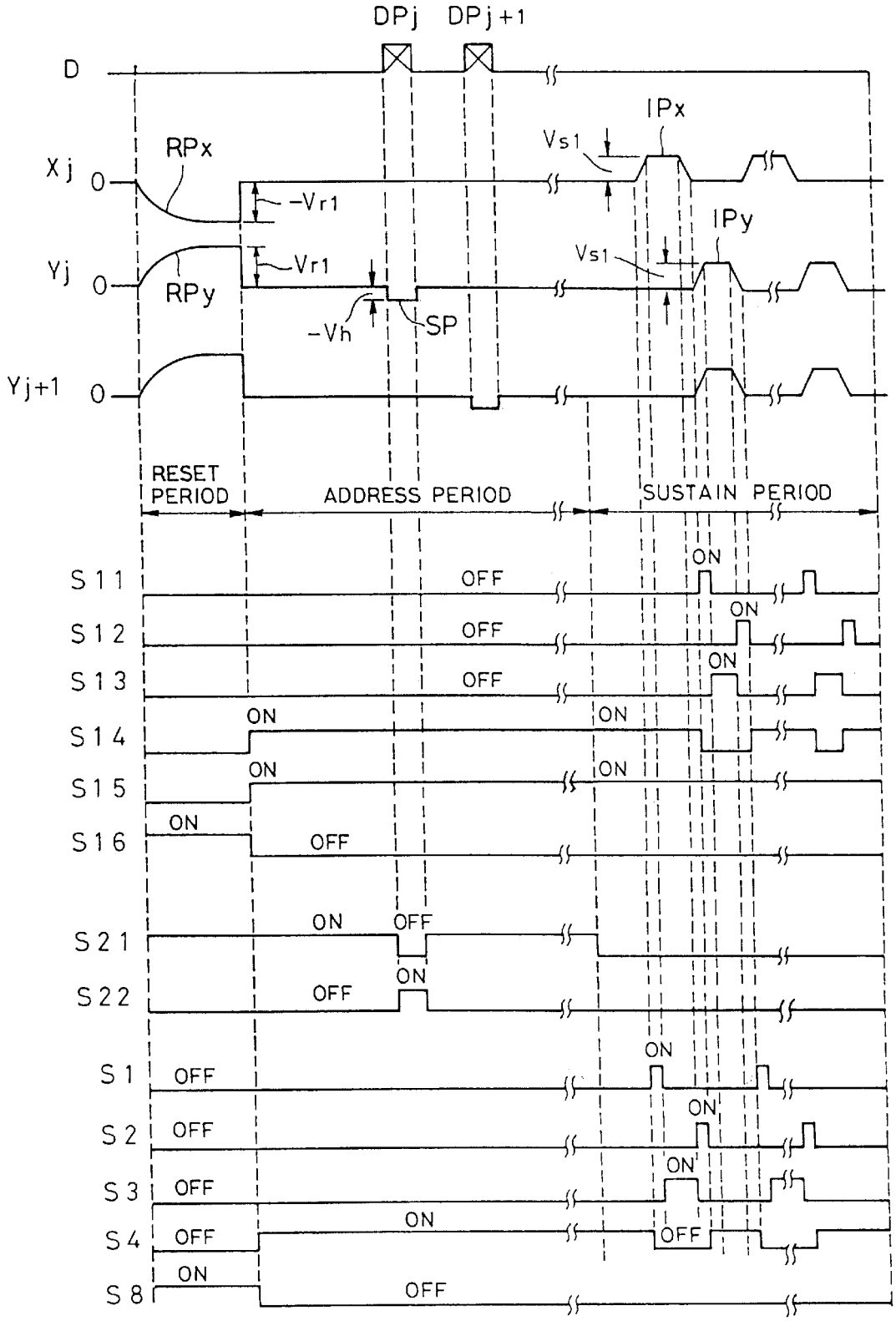
FIG. 7 is a timing chart for the individual sections of the apparatus in FIG. 6.

Through the above operation, the row-X electrode driver 3 applies the discharge sustain pulse $IP_x$ of a positive voltage as shown in FIG. 7 to the electrode $X_j$.

At the same time the switching element S4 is turned on at which the discharge sustain pulse $IP_x$ disappears, the switching element S11 is turned on and the switching element S14 is turned off in the row-Y electrode driver 4. When the switching element S14 is on, the electrode $Y_j$ is at the ground potential of 0 V; however, when the switching element S11 is turned on and the switching element S14 is turned off, the current flows to the electrode $Y_j$ via the coil L3, the diode D3, the switching element S11, the switching element S15 and the switching element S21 based on the charges stored in the capacitor C2, charging the capacitor C0. At this time, the potential of the electrode $Y_j$ gradually increases as shown in FIG. 7 due to the time constant of the coil L3 and the capacitor C0.

When a half of the resonance period determined by the coil L3 and the capacitor C0 passes, the switching element S11 is turned off and the switching element S13 is turned on. Consequently, the potential of the electrode $Y_j$ is clamped to the potential $V_{s1}$ on the positive terminal of the power supply B3. After a predetermined time elapses, the switching element S13 is turned off and the switching element S12 is turned on, causing the current to flow into the capacitor C2 via the diode D5, the switching element S15, the coil L4, the diode D4 and the switching element S12 because of the charges stored in the capacitor C0, thus charging the capacitor C2. At the time, the potential of the electrode $Y_j$ gradually decreases as shown in FIG. 7 due to the time constant of the coil L4 and the capacitor C0. When a half of the resonance period determined by the coil L4 and the capacitor C0 passes (when the potential of the electrode $Y_j$ reaches 0 V), the switching element S12 is turned off and the switching element S14 is turned on.

Through the above operation, the row-Y electrode driver 4 applies the discharge sustain pulse $IP_y$ of a positive voltage as shown in FIG. 7 to the electrode $Y_j$.

As apparent from the above, the discharge sustain pulses $IP_x$ and $IP_y$ are alternately generated and are alternately applied to the respective row electrodes $X_1$–$X_n$ and row electrodes $Y_j$–$Y_n$ in the sustain period. As a result, the light-emitting discharge cells where the wall charges remain repeat discharge emission and maintain the light-emitting state.

The above-described scan driver uses a PMOS-FET or an NMOS-FET as the switching element S21 and uses an NMOS-FET as the switching element S22, with the node of the series circuit of those switching elements serving as the output to the row electrode $Y_j$. The drive current from the second sustain driver is so designed as to flow in the path formed by the parallel-connected switching element S21 and diode D5 in the scan driver at the charging time and the discharging time.

When the switching element 21 is constituted of an MOS-FET, the diode D5 may be constructed by a parasitic diode in the MOS-FET.

Although the above-described embodiment is illustrated to take such a structure that the output of the second sustain driver is connected to the positive terminal of the power supply B6 of the scan driver (the other end of the switching element S21), it may have such a structure that the output of the second sustain driver is connected to the negative terminal of the power supply of the scan driver (the other end of the switching element S22).

Figure 8:
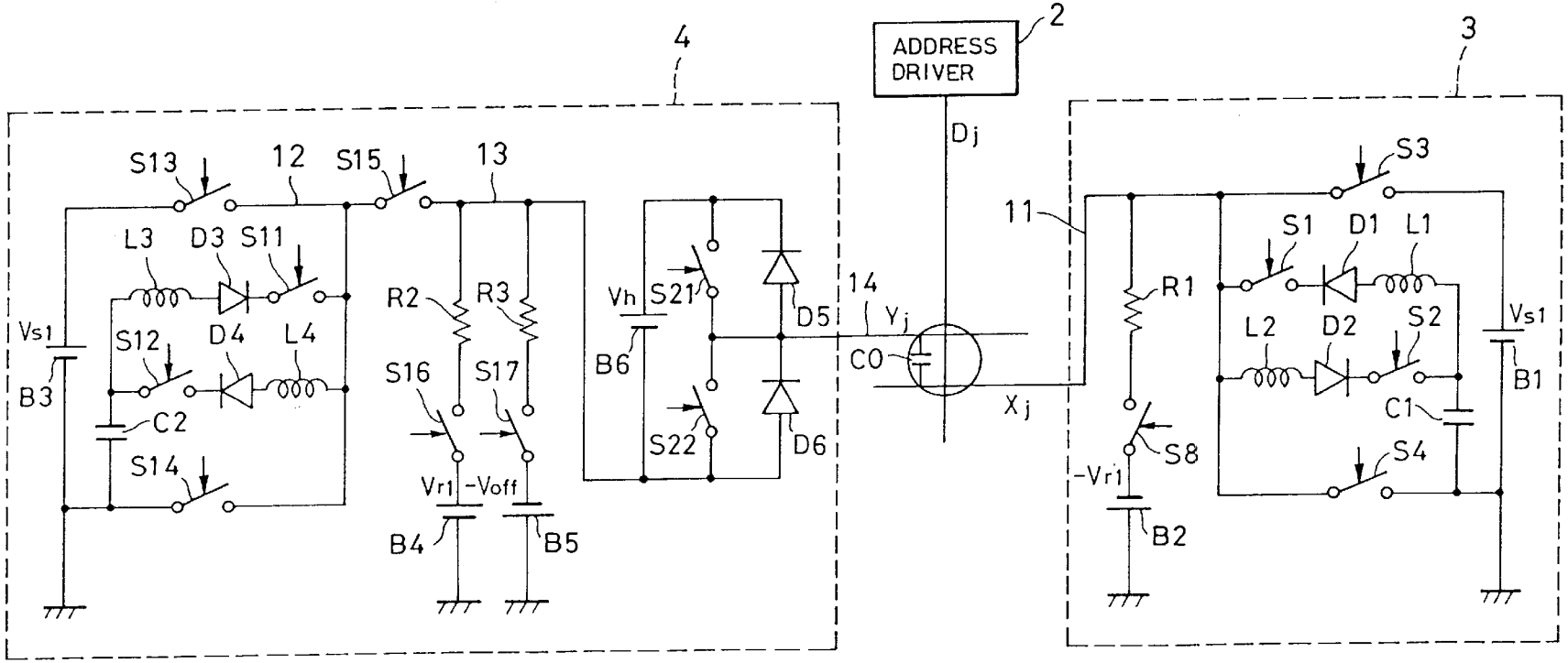
FIG. 8 is a circuit diagram illustrating another embodiment of the present invention.

FIG. 8 illustrates the structure of a PDP driving apparatus according to a further embodiment of the present invention, and uses the same reference symbols as used for those components which are the same as the corresponding components of the conventional apparatus shown in FIGS. 1 and 2 and the embodiment in FIG. 4. In the PDP driving apparatus in FIG. 8, a resistor R3 is inserted between the connection line 13 and the switching element S17 of the PDP driving apparatus in FIG. 4. Further, the power supply B4 has a positive terminal connected to one end of the switching element S16 and a negative terminal grounded.

The power supply B2 has a negative terminal connected to one end of the switching element S8 and a positive terminal grounded. The power supply B4 has a positive terminal connected to one end of the switching element S16 and a negative terminal grounded.

The power supply B5 provides a voltage $V_{off}$ (for example, 10 to 20 V) and the power supply B6 provides a voltage $V_h$ (for example, 140 V).

Since the other structure is the same as that of the PDP driving apparatus shown in FIG. 4, its description will not be repeated below.

Figure 3:
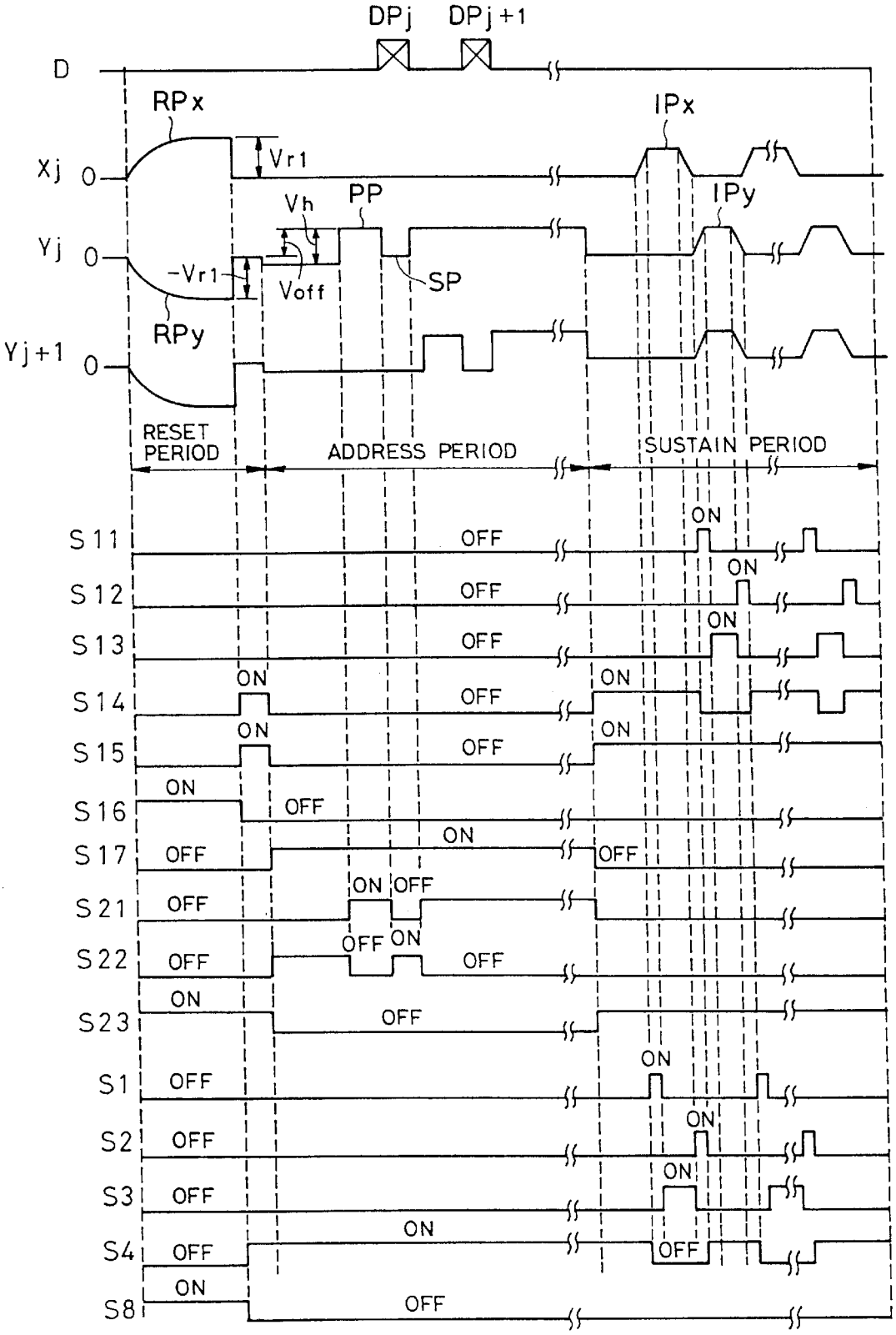
FIG. 3 PRIOR ART
FIG. 3 is a timing chart for the individual sections of the apparatus in FIG. 2.

The operation of the thus constituted driving apparatus for the PDP 1 will now be described with reference to a timing chart in FIG. 9. The drive sequence of this PDP 1 has one cycle consisting of a reset period, an address period and a sustain period as in the case of the driving apparatus in FIG. 3.

First, when the sequence enters the reset period, the switching element S8 in the row-X electrode driver 3 is turned on, and, simultaneously, the switching elements S16 and S22 in the row-Y electrode driver 4 are turned on. The other switching elements are off. The on action of the switching element S8 causes a current to flow to the negative terminal of the power supply B2 from the electrode $X_j$ through the resistor R1 and the switching element S8. The on action of the switching element S16 cause a current to flow to the electrode $Y_j$ from the positive terminal of the power supply B4 through the switching element S16, the resistor R2 and the switching element S22. The potential of the electrode $X_j$ gradually decreases at the rate specified by the time constant of the capacitor C0 and the resistor R1 and becomes the reset pulse $RP_x$, and the potential of the electrode $Y_j$ gradually increases at the rate specified by the time constant of the capacitor C0 and the resistor R1 and becomes the reset pulse $RP_y$. The potential of the reset pulse $RP_x$ is saturated to be $-V_{r1}$ and the potential of the reset pulse $RP_y$ is saturated to be $V_{r1}$. The reset pulses $RP_x$ are simultaneously applied to the respective row electrodes $X_1$ to $X_n$ and the reset pulses $RP_y$ are likewise simultaneously applied to the respective row electrodes $Y_1$ to $Y_n$. The The simultaneous application of those reset pulses $RP_x$ and $RP_y$ causes all the discharge cells of the PDP 1 to be excited for the discharge action, generating charge particles. After the discharging is completed, a predetermined amount of wall charges are evenly formed in the dielectric layers of the entire discharge cells, rendering those cells in a light-emitting discharge state.

After a predetermined time passes and the levels of the reset pulses $RP_x$ and $RP_y$ are saturated, the switching elements S8 and S16 are turned off before the end of the reset period. At this point of time, the switching elements S4, S14 and S15 are turned on, causing both the electrodes $X_j$ and $Y_j$ to be grounded. As a result, the reset pulses $RP_x$ and $RP_y$ disappear.

When the address period starts, the switching elements S14 and S15 are turned off, the switching elements S17 and S21 are turned on and at the same time the switching element S22 is turned off. The on actions of the switching elements S17 and S21 cause a positive potential ($V_h-V_{off}$) to be applied to the electrode $Y_j$.

In the address period, the address driver 2 selectively forms wall charges with respect to the individual discharge cells based on a video signal, thus generating pixel data pulses $DP_1$ to $DP_m$ for setting light-emitting discharge cells or non-emitting discharge cells, and applies the pixel data pulses to column electrodes $D_1$–$D_m$ display line by display line. As shown in FIG. 9, pixel data pulses $DP_j$ and $DP_{j+1}$ are respectively applied to the electrodes $Y_j$ and $Y_{j+1}$.

In synchronism with the application of the pixel data pulse $DP_j$ from the address driver 2, the switching element S21 is turned off and the switching element S22 is turned on. Consequently, a negative potential indicating the voltage $-V_{off}$ on the negative terminal of the power supply B5 is applied to the electrode $Y_j$ as the scan pulse SP via the switching element S22. In synchronism with the end of the pixel data pulse $DP_j$ from the address driver 2, the switching element S21 is turned on and the switching element S22 is turned off, causing the predetermined positive potential ($V_h-V_{off}$) to be applied to the electrode $Y_j$. Thereafter, as in the case of the electrode $Y_j$, the scan pulse SP is likewise applied to the electrode $Y_{j+1}$ in synchronism with application of the pixel data pulse $DP_{j+1}$ from the address driver 2, as shown in FIG. 9.

Of the discharge cells relating to the row electrode to which the scan pulses have been applied, only those discharge cells to which the respective pixel data pulses of a positive voltage have also been applied have a discharge action and the wall charges will be lost. Since no discharging occurs in those discharge cells which have been applied with the scan pulses but not with the respective pixel data pulses of a positive voltage, the wall charges remain. At the time, the discharge cells in which the wall charges have remained become light-emitting discharge cells while those from which the wall charges have disappeared become non-emitting discharge cells.

At the transition to the sustain period from the address period, the switching elements S17 and S21 are turned off and at the same time, the switching elements S14, S15 and S22 are turned on. It is to be noted that the switching element S1 maintains the on state.

Figure 9:
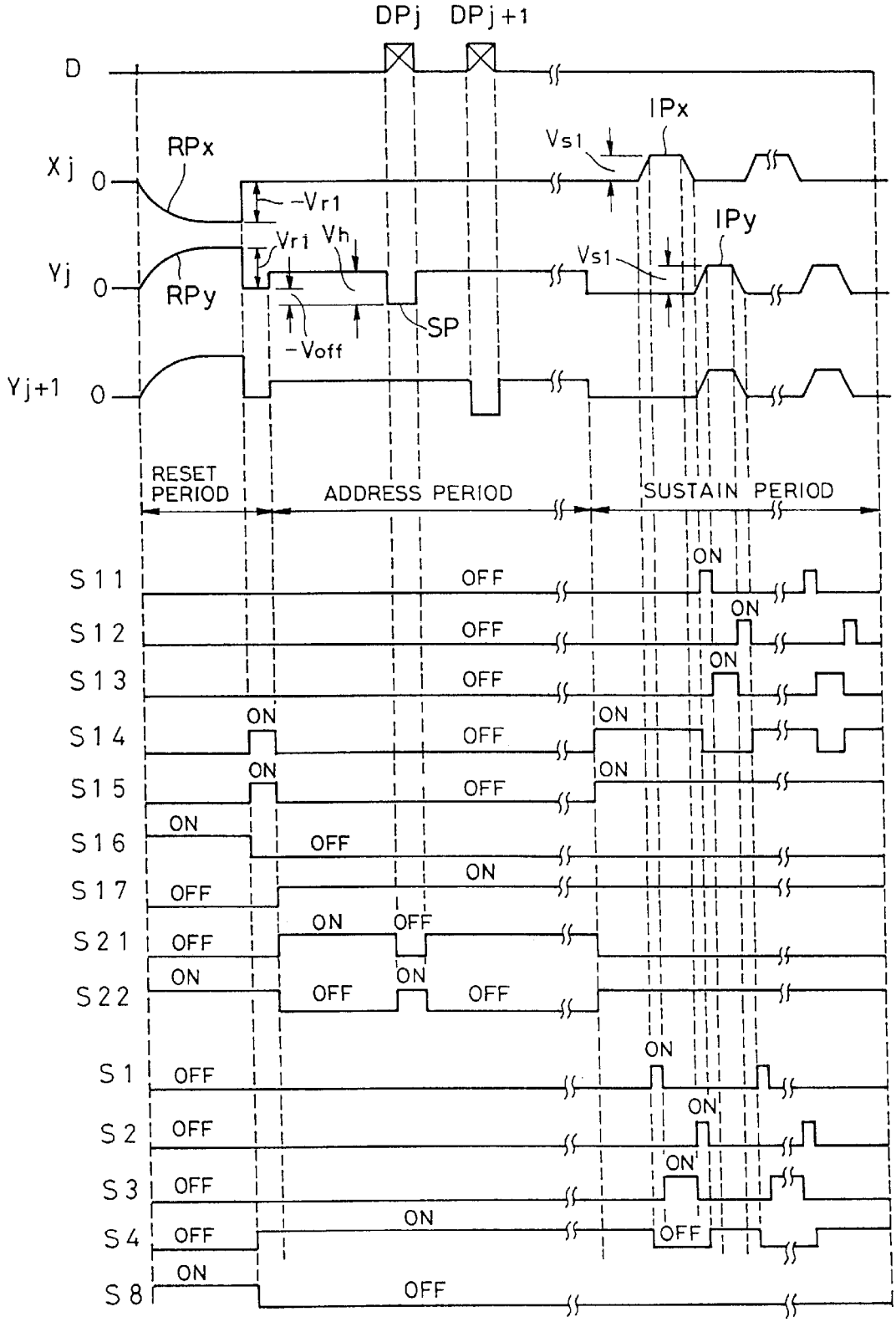
FIG. 9 is a timing chart for the individual sections of the apparatus in FIG. 8.

Since the operation of the row-X electrode driver 3 in the sustain period is the same as that of the apparatus shown in FIGS. 1 and 2, the operational description will not be repeated except that the row-X electrode driver 3 applies the discharge sustain pulse $IP_x$ of a positive voltage as shown in FIG. 9 to the electrode $X_j$.

At the same time the switching element S4 is turned on at which the discharge sustain pulse $IP_x$ disappears, the switching element S11 is turned on and the switching element S14 is turned off in the row-Y electrode driver 4. When the switching element S14 is on, the electrode $Y_j$ is at the ground potential of 0 V; however, when the switching element S11 is turned on and the switching element S14 is turned off, the current flows to the electrode $Y_j$ via the coil L3, the diode D3, the switching element S11, the switching element S15 and the diode D6 based on the charges stored in the capacitor C2, charging the capacitor C0. At the time, the potential of the electrode $Y_j$ gradually increases as shown in FIG. 9 due to the time constant of the coil L3 and the capacitor C0.

When a half of the resonance period determined by the coil L3 and the capacitor C0 passes, the switching element S11 is turned off and the switching element S13 is turned on. Consequently, the potential of the electrode $Y_j$ is clamped to the potential $V_{s1}$ on the positive terminal of the power supply B3. After a predetermined time elapses, the switching element S13 is turned off and the switching element S12 is turned on, causing the current to flow into the capacitor C2 via the switching element S22, the switching element S15, the coil L4, the diode D4 and the switching element S12 because of the charges stored in the capacitor C0, thus charging the capacitor C2.

At the time, the potential of the electrode $Y_j$ gradually decreases as shown in FIG. 9 due to the time constant of the coil L4 and the capacitor C0. When a half of the resonance period determined by the coil L4 and the capacitor C0 passes (when the potential of the electrode $Y_j$ reaches 0 V), the switching element S12 is turned off and the switching element S14 is turned on.

Through the above operation, the row-Y electrode driver 4 applies the discharge sustain pulse $IP_y$ of a positive voltage as shown in FIG. 9 to the electrode $Y_j$.

As apparent from the above, the discharge sustain pulses $IP_x$ and $IP_y$ are alternately generated and are alternately applied to the respective row electrodes $X_1$–$X_n$ and row electrodes $Y_1$–$Y_n$ in the sustain period. As a result, the light-emitting discharge cells where the wall charges remain repeat discharge emission and maintain the light-emitting state.

The above-described scan driver uses a PMOS-FET or an NMOS-FET as the switching element S21 and uses an NMOS-FET as the switching element S22, with the node of the series circuit of those switching elements serving as the output to the row electrode $Y_j$. The drive current from the second sustain driver is so designed as to flow in the path formed by the parallel-connected switching element S22 and diode D6 in the scan driver at the charging time and the discharging time.

When the switching element 22 is constituted of an MOS-FET, the diode D6 may be constructed by a parasitic diode in the MOS-FET.

As apparent from the above, the present invention can supply the discharge sustain pulse current to the PDP during the sustain period without going through a bypass circuit comprising a switching element, and can thus prevent the circuit scale from increasing.

What is claimed is:

1. A plasma display panel driving apparatus for driving a plasma display panel having plural pairs of row electrodes and a plurality of column electrodes laid perpendicular to said pairs of row electrodes, forming discharge cells at respective intersections of said pairs of row electrodes and said column electrodes, said apparatus comprising:

a sustain driver for supplying a discharge sustain pulse to one of each of said plural pairs of row electrodes to permit only a light-emitting discharge to maintain light emission; and a scan driver for supplying a scan pulse to one of each of said pairs of row electrodes to select a light-emitting discharge cell and a non-emitting discharge cell, a drive current by said sustain driver flowing through the same path in said scan driver at a charging time and a discharging time, wherein said scan driver has two switching elements having one end commonly connected to the other one of each of said plural pairs of row electrodes, and when said scan driver is in operation, a first potential is applied to the other end of one of said two switching elements and a second potential lower than said first potential and equal to a potential of said scan pulse is applied to the other end of the other one of said two switching elements; and when said sustain driver is in operation, an output of said sustain driver is electrically connected to said other end of said one of said two switching elements or said other one thereof.

2. The plasma display panel driving apparatus according to claim 1, wherein the path of a drive current by said sustain driver includes one of said two switching elements and a diode connected in parallel thereto or the other one of said two switching elements and a diode connected in parallel thereto.

* * * * *